US006070536A

United States Patent [19]

Cinkaj

[11] Patent Number: 6,070,536

[45] Date of Patent: Jun. 6, 2000

[54] DECORATIVE SHELVING AND METHOD OF MAKING SAME

[76] Inventor: Chris Cinkaj, 827 Hulmeville Rd., Langhorne, Pa. 19047

[21] Appl. No.: 09/061,257

[22] Filed: Apr. 17, 1998

[51] Int. Cl.[7] ..... A47B 5/00

[52] U.S. Cl. ..... 108/152; 211/90.01; 108/42

[58] Field of Search ..... 108/42, 152; 211/90.01, 211/134, 148, 186; 52/36.4; 298/201; 312/258, 265.1, 265.2, 245, 210, 111

[56] References Cited

U.S. PATENT DOCUMENTS

| | | | |
|---|---|---|---|
| 1,683,168 | 9/1928 | Dambach | 211/134 |
| 2,649,350 | 8/1953 | Backus et al. | 312/258 |
| 2,794,555 | 6/1957 | Schild . | |
| 2,993,603 | 7/1961 | Fohn . | |
| 3,225,940 | 12/1965 | Story . | |
| 3,311,435 | 3/1967 | Heritage | 108/152 |
| 3,347,187 | 10/1967 | Khoury | 108/152 |
| 3,704,675 | 12/1972 | Bellasalma | 108/152 |
| 3,718,101 | 2/1973 | Sacks | 108/152 |
| 4,308,963 | 1/1982 | Worrallo | 211/153 |
| 4,535,898 | 8/1985 | Jones et al. | 211/153 |
| 5,188,246 | 2/1993 | Maxworthy | 211/153 |
| 5,415,302 | 5/1995 | Carlson et al. | 211/187 |
| 5,560,580 | 10/1996 | Almoslino | 248/345.1 |
| 5,876,004 | 3/1999 | Ralph | 248/201 |

FOREIGN PATENT DOCUMENTS

| | | | |
|---|---|---|---|
| 1326724 | 8/1973 | United Kingdom | 52/36.4 |
| 2 016 907 | 9/1979 | United Kingdom . | |
| 2 237 729 | 5/1991 | United Kingdom . | |
| 83/00008 | 1/1983 | WIPO . | |

*Primary Examiner*—Anthony D. Barfield
*Assistant Examiner*—Jerry A. Anderson
*Attorney, Agent, or Firm*—Richard C. Litman

[57] ABSTRACT

A decorative shelving for use in the home or in the office. The shelving appears as if it is a part of the original home or office because the shelving matches the original wall surface. The building design and installation is unique because it not only ensures strength and quality, but it also ensures a nearly perfect match with the original wall surface. The shelving method of assembly is very cost effective compared to conventional building methods. The decorative shelving is self-supporting with no visible means of support. The shelving has a cantilever design that has superior strength without the use of struts. The shelving comprises a novel shelf support structure with the shelf having a modular framework.

6 Claims, 10 Drawing Sheets

DECORATIVE SHELVING AND METHOD OF MAKING SAME

BACKGROUND OF THE INVENTION

1. Field of the Invention

The present invention relates to a novel decorative shelving, more particularly, an assembly which upon installation matches the original wall surface and ensures not only strength and quality, but a nearly perfect match with the original wall surface.

2. Description of Related Art

It is common practice in the construction industry to build shelves in a home or office during the construction of the home or office building. However, having subcontractors build the shelving during the original construction is expensive and does not provide the homeowner or tenant with an opportunity to select the shelving of his or her choice. Conventional methods require that more than one trade is needed to construct a built-in shelf; plus, with a variety of other materials involved, it becomes extremely expensive to have a single shelf installed. In addition, quality and strength are somewhat compromised.

Often when shelving is put up during the original construction, the shelving does not always match the texture of the wall surface to which the shelving is attached. The contrast in the textures of the shelving and the wall surface leads to undesirable aesthetics. When installing wall mounted shelving, it is customarily done using brackets or struts to provide support for the shelving.

However, the prior art fails to solve the aforementioned problems; for example, U.S. Pat. No. 3,225,940 issued to W. K. Story on Dec. 28, 1965 describes a closet shelf and hanger assembly wherein the closet shelf and the rod onto which the hangers are hung is a single unit instead of separate independent units. The hangers are either hung directly on the rod or on hooks suspended from the rod. The construction of the shelf and hanger assembly is such that the hangers can readily traverse the rod onto which the hangers have been hung.

U.S. Pat. No. 4,535,898 issued to Harold Jones on Aug. 20, 1985 describes a shelving structure that is assembled from a number of vertical struts and interconnected horizontal beams. The shelf is formed from metal sheet and consists of a rectangular shelf panel and flanges wherein the flanges are an integral part of the shelf panel. Each flange is so folded so as to provide a pocket, and a reinforcing element is positioned in each pocket to engage the underside of the shelf panel.

U.S. Pat. No. 5,415,302 issued on May 16, 1995 to Bradley J. Carlson describes a modular shelving system that includes a horizontal polygonal base shelf assembly, a horizontal top shelf assembly, a plurality of vertical support posts, and one or more intermediate shelf assemblies positioned between the top shelf assembly and the bottom shelf assembly. The shelving system is an improved "knock-down" modular, vertical, formed-wire shelving system that is especially well-suited for retail applications, and which may be readily assembled and disassembled without tools to facilitate shipping, storing and cleaning.

U.S. Pat. No. 3,704,675 issued on Dec. 5, 1972 to Gerald J. Bellasalma describes a cantilever shelf assembly that is mounted on a wall and consists of a shelf body having a reinforcing plate embedded in a molded synthetic resin having locking portions that extend through openings in the plate and in which the plate has a rearward extension formed with an upstanding flange that is removably received in the channel of an elongated bracket secured to the wall on which the shelf is mounted. The body of the shelf assembly is made of molded synthetic resin, for example, foamed polyurethane.

U.S. Pat. No. 5,560,580 issued to Hans Almoslino on Oct. 1, 1996 describes a decorative covering for shelf brackets and standards. The blade-like horizontal brackets for supporting a shelf are connected to vertical standards. A bracket is made from sheet metal as an elongated, blade-like arm having mounting hooks that engage in selected slots of a vertical standard. The decorative covering is formed with a first groove for receiving a conventional shelf bracket and a second groove for receiving a standard. The decorative cover completely conceals both the horizontal blade and the vertical standard and enhances the appearance of a shelving system and provides the look of finished furniture.

United Kingdom Patent Specification No. 2,237,729 A, published on May 15, 1991, describes a supported assembly that comprises a generally U-shaped channel that is secured to a vertical surface and a sheet of rigid material, such as wood or glass that is inserted into the opening of the channel. The channel is fixed to the vertical surface in a horizontal plane so that the sheet extends substantially horizontally and is supported by the channel. The channel comprises an extruded aluminum member that has a U-shaped cross-section and resilient members, for example, EPDM gaskets mounted on each edge of the member to define the opening in the channel.

None of the above inventions and patents, taken either singly or in combination, is seen to describe the instant invention as claimed. Thus, there exists a need for decorative shelving that is self-supporting with no visible means of support and that is well-suited for holding and displaying items in both commercial and residential dwellings.

SUMMARY OF THE INVENTION

Accordingly, it is a principal object of the invention to provide a decorative shelving that is self-supporting with no visible means of support.

It is another object of the invention to provide a decorative shelving with a true cantilever design that has increased support strength without the use of struts or brackets.

It is a further object of the invention to provide a decorative shelving that after installation matches the original wall surface.

It is an object of the invention to provide improved elements and arrangements thereof in a decorative shelving for the purposes described that is inexpensive, dependable and fully effective in accomplishing its intended purposes.

The present invention is a self-supporting shelf that has no visible means of support. The present invention uses a cantilever design that gives the decorative shelving incredible support strength without the use of concealed brackets or struts. The support strength is sufficient to hold relatively heavy objects; for example, a large television set. The unique building design of the decorative shelving ensures superior quality and at the same time is very cost effective compared to conventional building methods. Because the decorative shelving is installed after construction of the dwelling is completed, there are no additional labor costs.

The ability to match the decorative shelving with the original wall surface results in an appearance so striking and authentic that the decorative shelving appears to be an integral part of the wall to which it is attached. The modular framework of the decorative shelving allows for an almost limitless selection of shelving shapes.

The decorative shelving has either a textured finish or a smooth finish depending upon whether or not the original wall surface is textured or smooth. Two types of materials are used, depending upon the type of finish desired. For a smooth finish, medite is used, while for a textured finish, particle board is used. The appropriate selection of materials results in a decorative shelf that will not sag, twist, crown, cup, or bow, but instead will maintain a straight, sturdy finish.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention pertains to a decorative shelving assembly that is self-supporting; that is, the decorative shelving does not use brackets or struts for support. In fact, the shelving has no visible means of support. The decorative shelving has a cantilever design that has incredible support strength. In addition, the decorative shelving has a modular construction which allows for enormous versatility in the number of shapes and finishes.

Figure 1A:
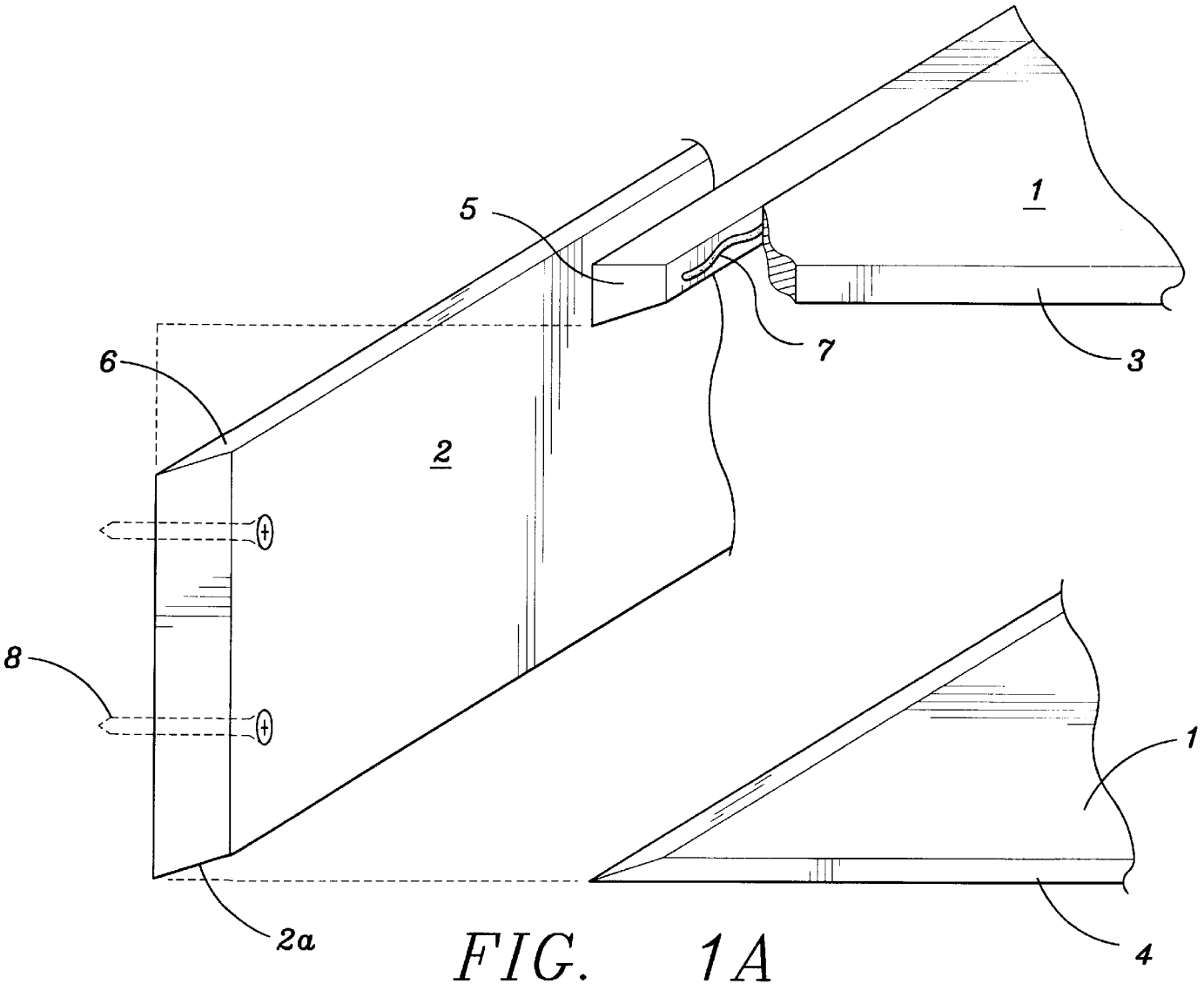
FIG. 1A is an exploded, perspective cutaway view of the weight transferring components of the decorative shelf of the present invention.
Figure 1B:
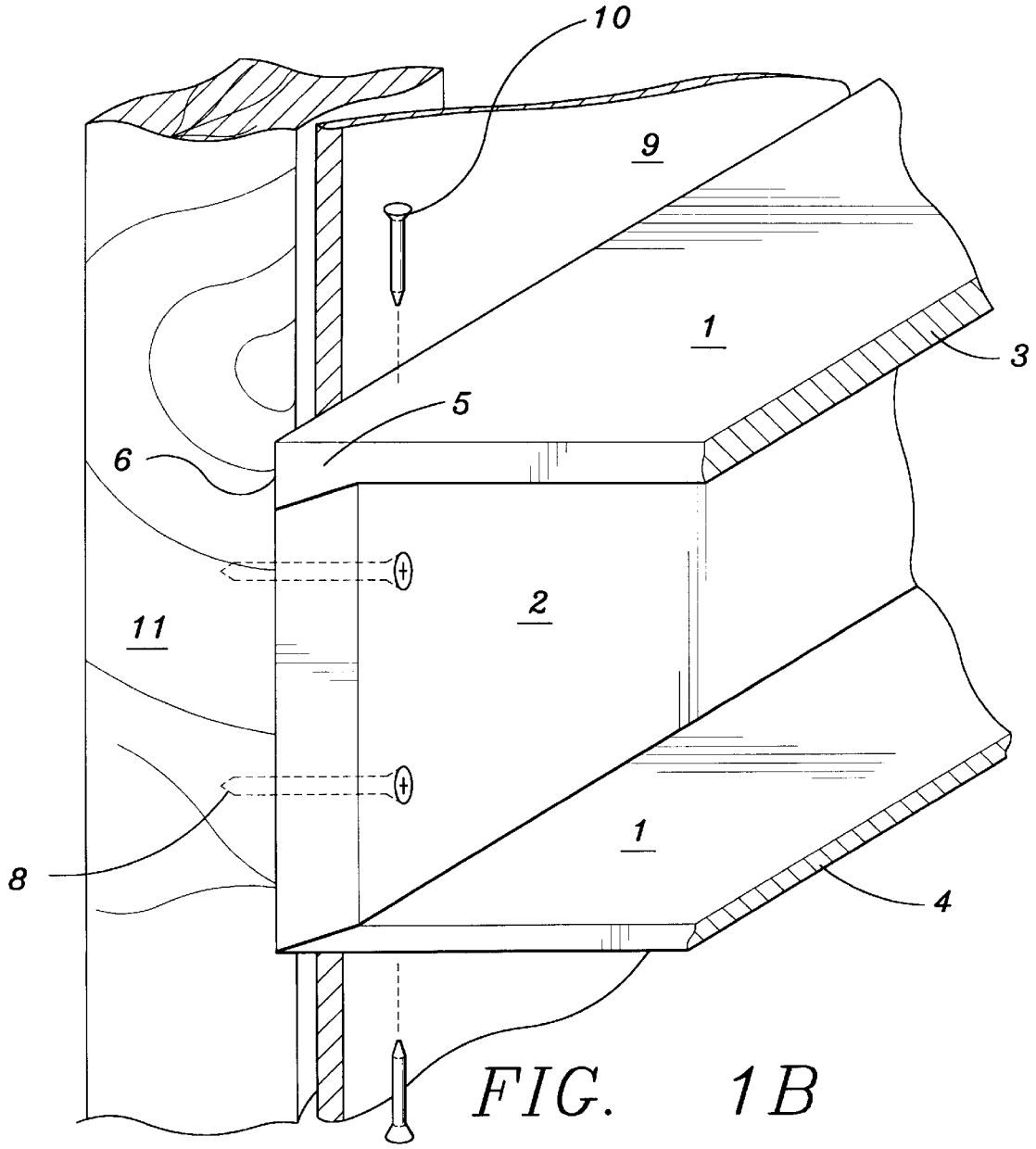
FIG. 1B is a perspective, cutaway view of the components of FIG. 1A as mounted to a wall.
Figure 2:
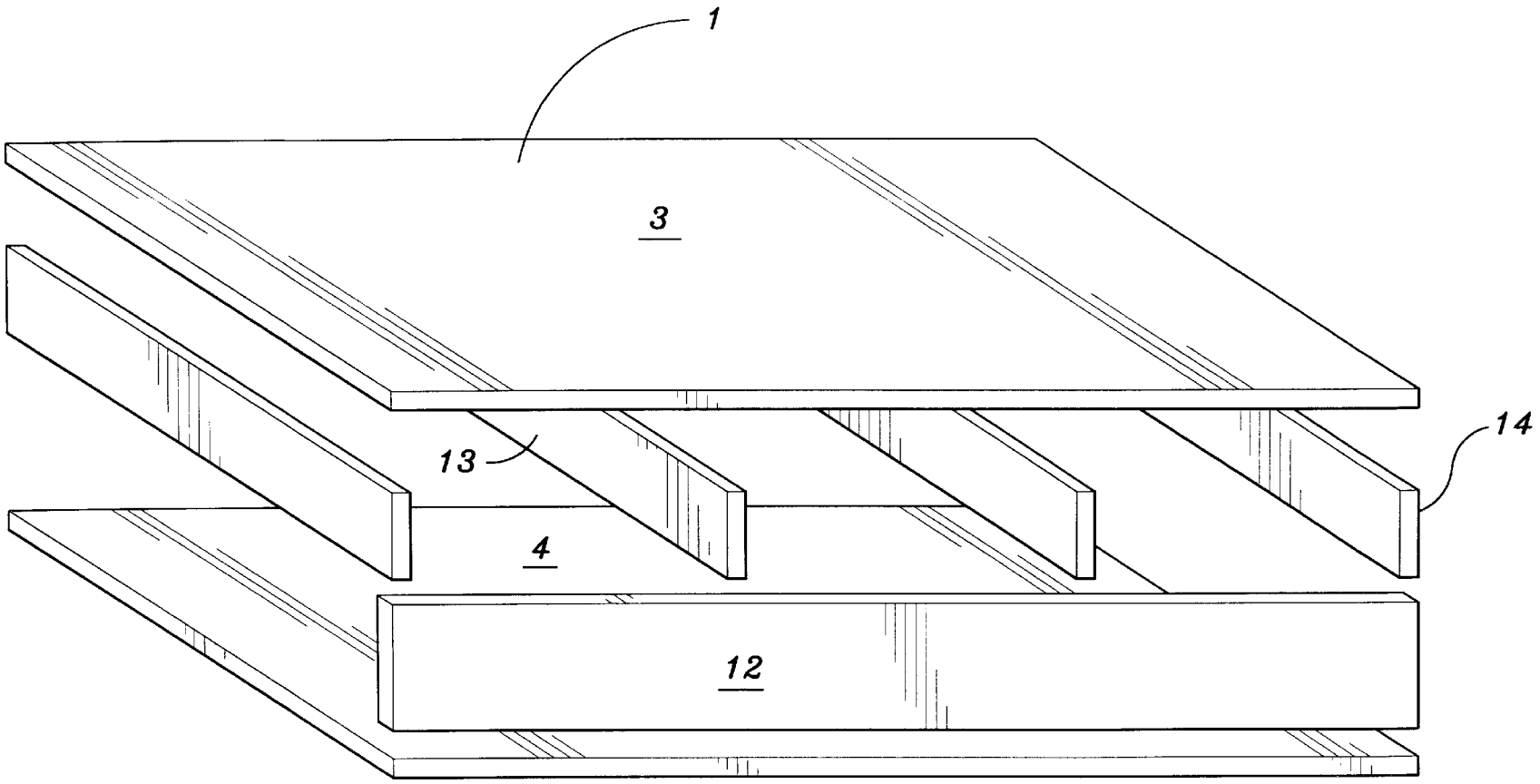
FIG. 2 is an exploded, perspective view of the shelving components of the decorative shelf.
Figure 3:
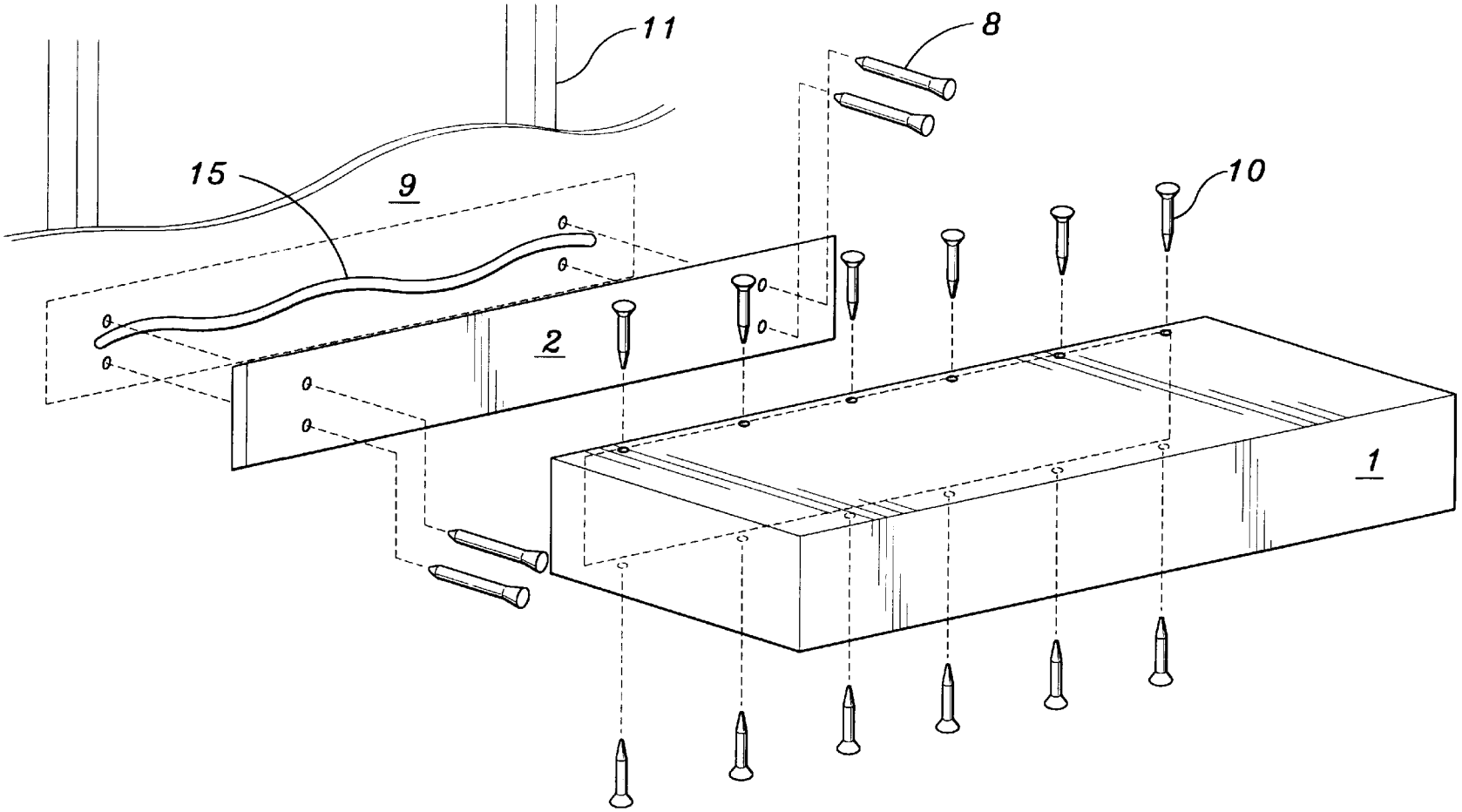
FIG. 3 is a perspective view of the shelving components of FIG. 2 as joined, as exploded from the wall mounting components and their fasteners.

FIGS. 1—3 show a preferred embodiment of the present invention, and should be referred to together. FIG. 1A is a perspective view of the decorative shelf 1 showing how the shelf 1 is attached to the shelf support 2. The top and bottom edges of the shelf support 2 are angled as shown in FIG. 1A. The top piece 3 of the modular shelf 1 has a retaining lip 5 along the edge of the top piece 3 that attaches to the angled top edge of the shelf support 2. The retaining lip 5 of the top piece 3 of the shelf 1 reinforces the joint 6 between the shelf support 2 and the top piece 3 of the shelf 1 and increases the strength of the joint 6.

The bottom piece 4 of the shelf 1 has an angled edge that attaches to the angled bottom edge 2*a* of the shelf support 2.

In the simplest form of the present invention, the edges of the shelf support 2 are not adapted to have a bevel included by the retaining lip 5, but instead the edges are planar, in accordance with only the top piece 3 as shown in FIG. 1A. However, the beveled configuration of the shelving component when joined together, as depicted in FIG. 1A, is used when the shelf 1 is expected to carry heavy loads. The retaining lip 5 is attached to the rear edge of the top piece 3 using carpenters glue 7 and 1¼" staples (not shown) with a ¼" crown.

FIG. 1B shows the shelf 1 joined to the shelf support 2. The shelf support 2 is secured to the wall 9 using wall screws 8 and latex adhesive (not shown) with the wall screws 8 extending through the wall 8 and into the wall frame 11. The edge of the top piece 3 of the shelf 1 and the edge of the bottom piece 4 of the shelf 1 are attached to the shelf support 2 using carpenters glue 7 and are further secured to the shelf support 2 by pin nails 10.

FIG. 2 shows an exploded view of the shelf 1 and its modular framework comprising multiple component parts. The retaining or overhanging lip 5 is not shown in FIG. 2 (i.e. an unjoined configuration) for clarity of illustration. FIG. 2 shows the relationship between the component parts of the shelf 1 as they are assembled to form the shelf 1. The component parts of the shelf 1 consist of a top piece 3 that forms the upper surface of the shelf 1, a bottom piece 4 that forms the lower surface of the shelf 1, a face edge 12 that forms the front surface of the shelf 1, two side vertical support ribs 14 that form the sides of the shelf 1, and two center vertical support ribs 13 that provide support for the center of the shelf 1.

FIG. 3 is an view of such shelving components as joined with the wall frame 11 exploded therefrom shown in the background. The shelf support 2 is secured to the wall 9 surface using both a latex adhesive 15 and wall screws 8. A latex adhesive 15 is applied to all mating edges of the shelf support 2 and the shelf 1. The edges of the shelf support 2 are either squared or beveled. The shelf 1 is then slipped over the shelf support 2 and pin nailed 10 to the shelf support 2 with 1½" pin nails 10. The pin nails 10 are applied 6" on center.

Figure 4A:
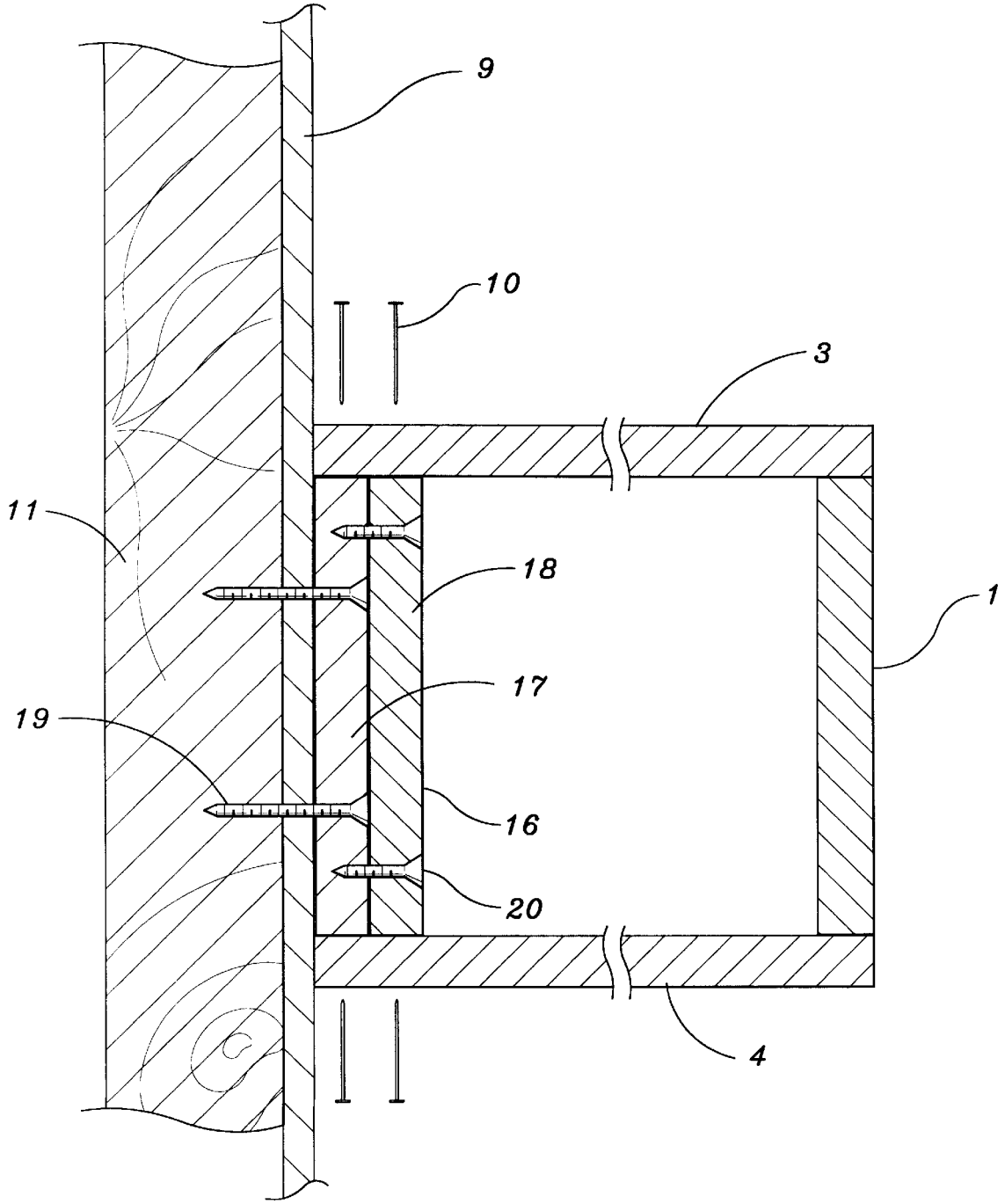
FIG. 4A is a sectional, broken side view of a planar, double mounting component and shelving component of a second embodiment of the present invention.

In an alternate and second embodiment depicted in FIG. 4A, the shelf support 16 is doubled in thickness by using two shelf supports 17,18 back-to-back to provide a larger cantilever. The double shelf support 16 embodiment is used when the shelf has to support unusually heavy loads. In the embodiment depicted in FIG. 4A, the edges of the shelf support 16 are planar or squared. FIG. 4A shows that the double shelf support 16 consists of two shelf supports 17,18 attached back-to-back with one of the shelf supports 17 secured to the wall 9 using latex adhesive 15 and long wall screws 19 that penetrate deeper into the wall frame 11 than the wall screws 8 of the shelf support 2 of the preferred embodiment.

As is seen in FIG. 4A, a second shelf support 18 is secured to the first shelf support 17 using shorter screws 20 that do not extend beyond the thickness of the first shelf support 17 and carpenters glue (not shown). Both the top piece 3 and the bottom piece 4 of the shelf 1 are secured to the double shelf support 16 by pin nails 10 that are nailed through the top piece 3 and the bottom piece 4 of the shelf 1 into both shelf supports 17,18 of the double shelf support 16 arrangement and by carpenters glue (not shown) applied to all mating surfaces of the installed shelf supports 17,18.

Figure 4B:
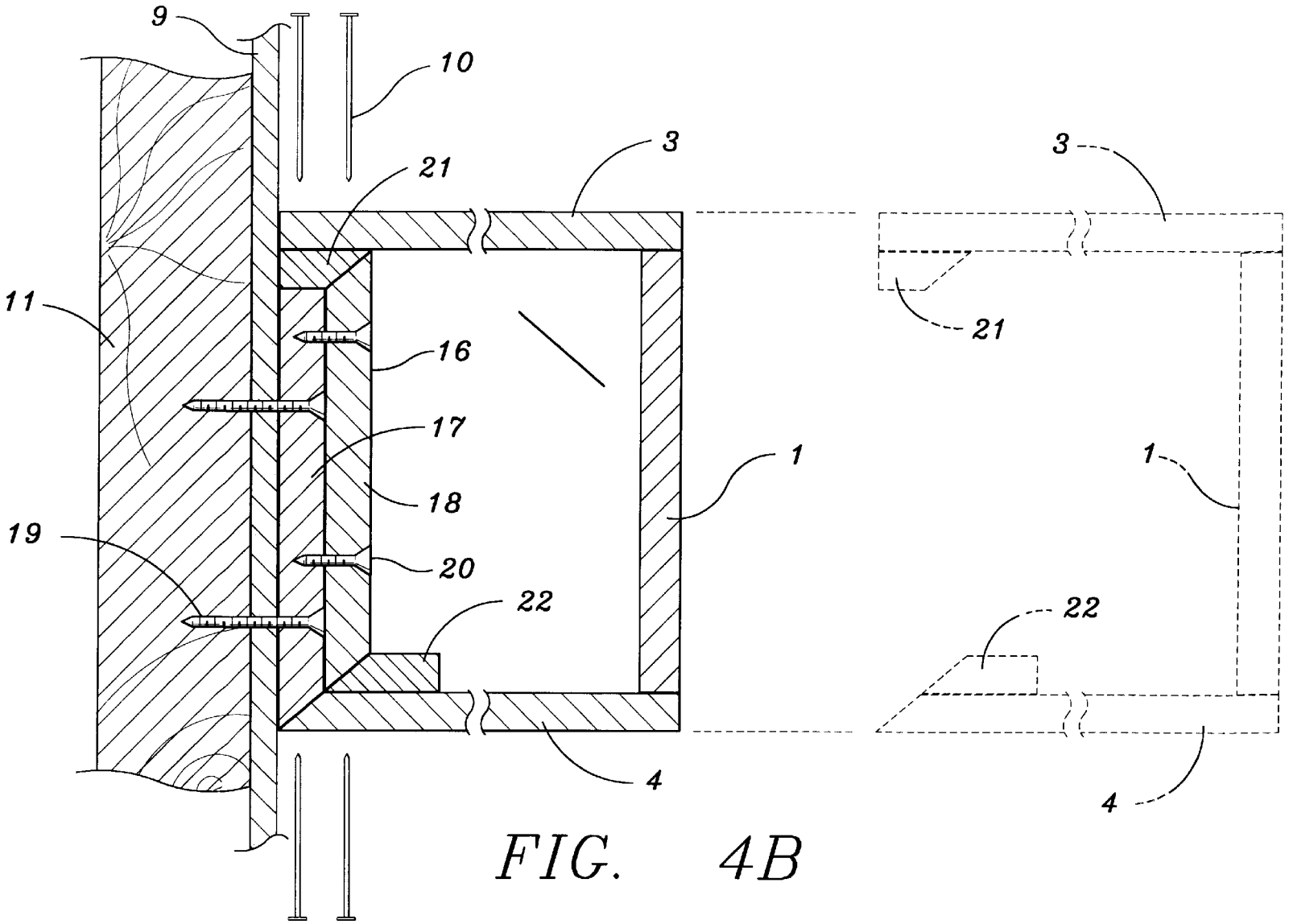
FIG. 4B is a sectional, broken side view of a beveled, double mounting support and shelving component of a third embodiment of the present invention, wherein phantom lines represent the shelving components as joined pulled away from the mounting components.

In yet another and third embodiment depicted in FIG. 4B, the edges of the shelf support 16 are again beveled or angled similar to that of the embodiment shown in FIG. 1A; however, increase surface area is provided over which the bevel engages the wall mounting component. One of two of the wall mounting components, the shelf support 17, shown attached directly to the wall 9, has a planar top edge and a beveled bottom edge. The second component, the adjacent shelf support 18, has a beveled top edge and a beveled bottom edge. The beveled edges are beveled to an angle of 45 degrees. However, other beveled edge angles may be used.

The mating portions of the shelf 1 include the top piece 3 which abuts the wall 9, and to which is added an overhanging lip 21 which engages the beveled cavity formed by the joined supports 17,18. To the bottom piece 4 of the shelf 1 is added a reinforcing base block 22, which matingly engages the beveled bottom edges of the joined supports 17,18. This particular configuration is designed to support maximum weight loads by providing an added surface area over which the shelf 1 can distribute the cantilever forces to the supports 17,18. A side view of the shelf 1 uninstalled is shown in phantom lines in FIG. 4B.

Figure 5:
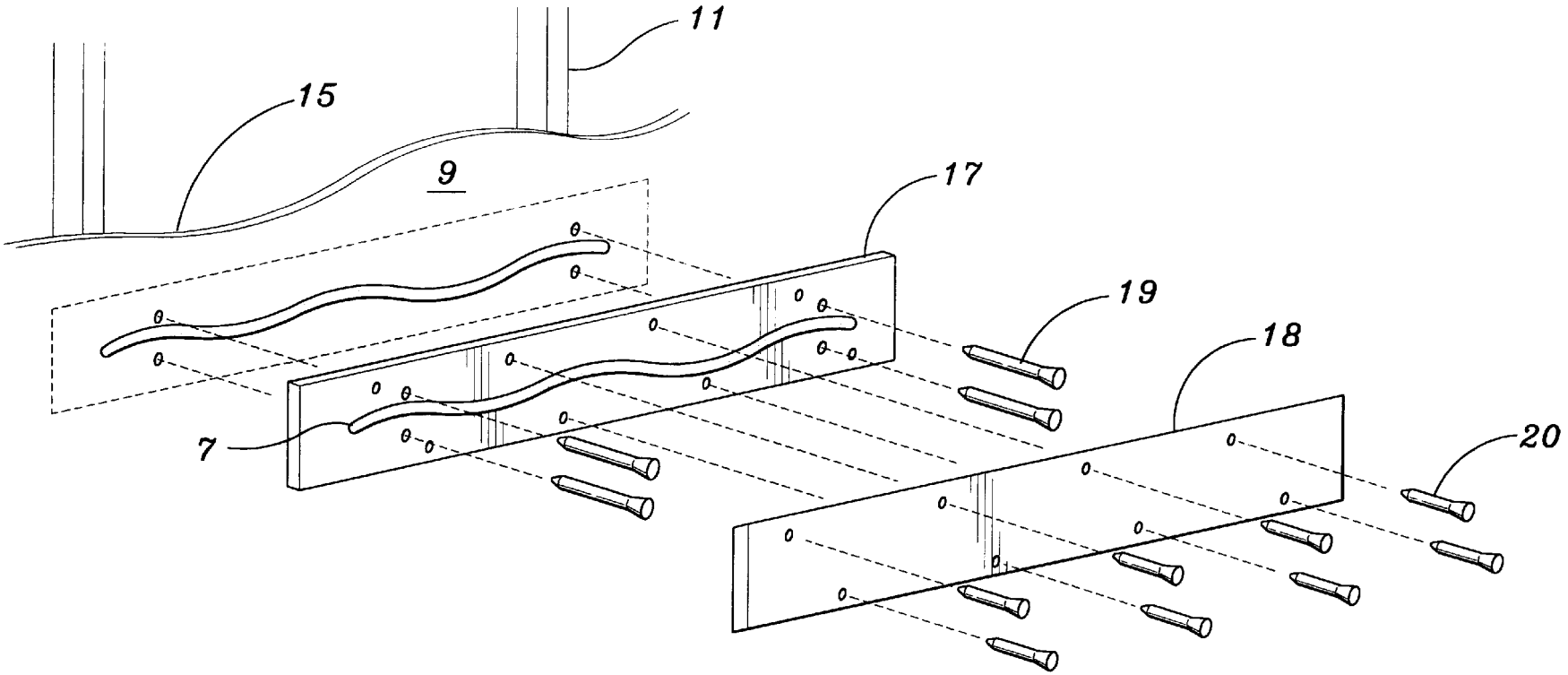
FIG. 5 is an exploded view of the double mounting support of the third embodiment.

FIG. 5 shows an exploded view of the double shelf support 16 arrangement. The first shelf support 17 is secured to the wall 9 using latex adhesive 15 and long wall screws 19, while the second shelf support 18 is secured to the first shelf support 17 using carpenters glue 7 and shorter screws 20. The edges of the shelf supports 17,18 are shaped so as to conform to the configurations depicted in FIGS. 4A and 4B. However, there are other possible configurations.

Figure 6:
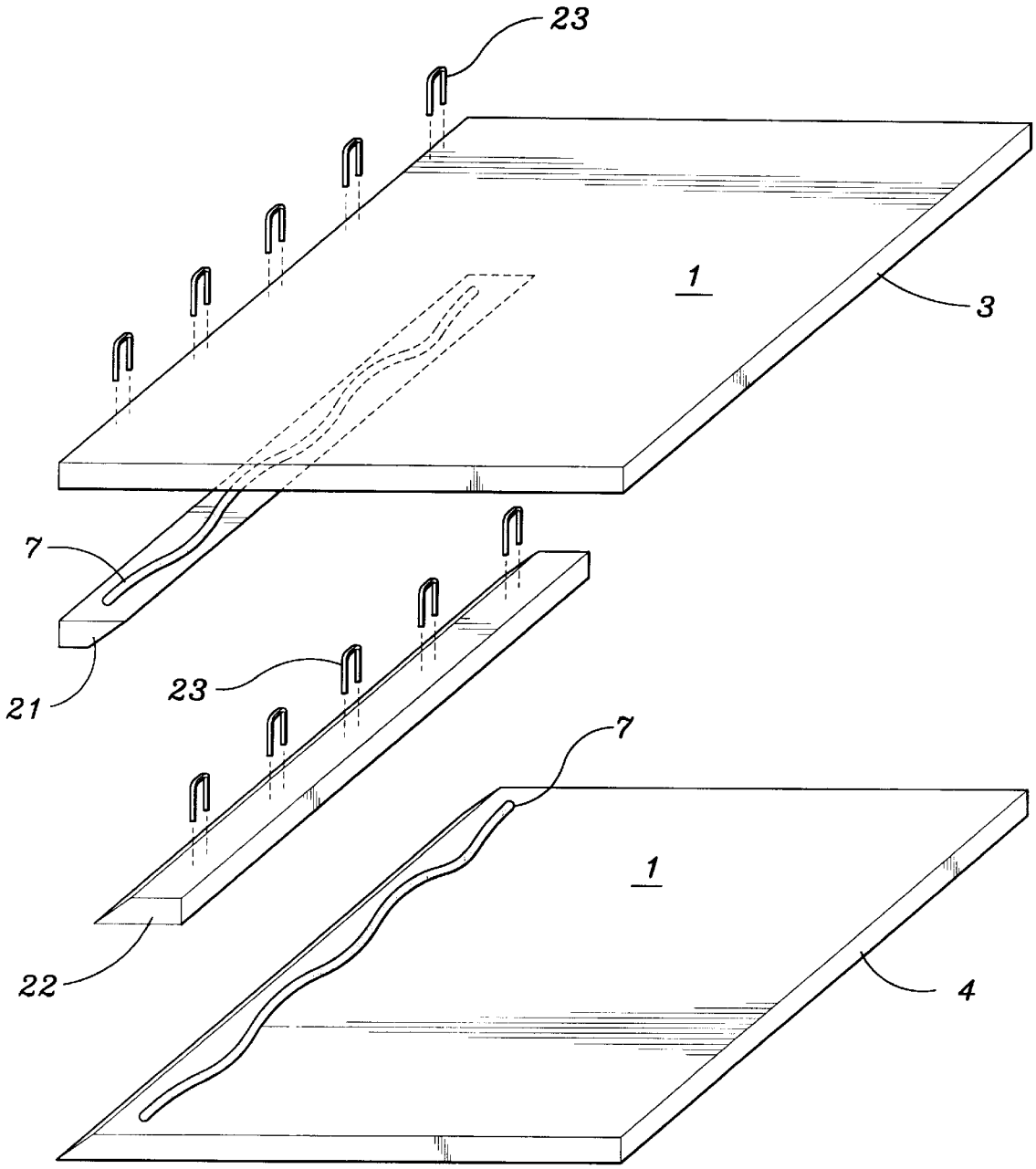
FIG. 6 is an exploded, perspective view of shelf reinforcing features of the shelving components of the third embodiment.
Figure 7A:
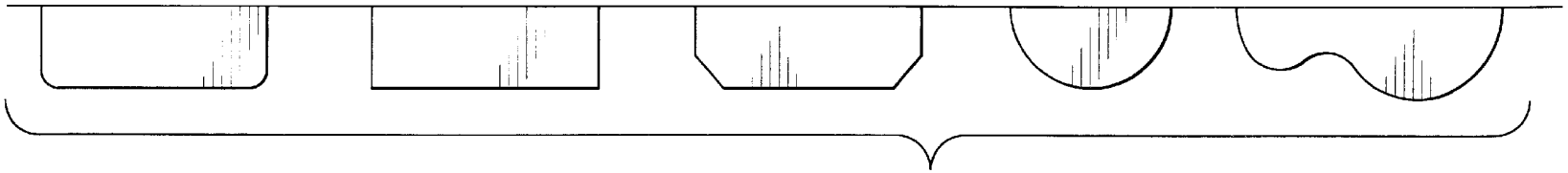
FIG. 7A is a top view of basic shelf shapes which can be mounted to a planar surface using the mounting components of the present invention.
Figure 7B:
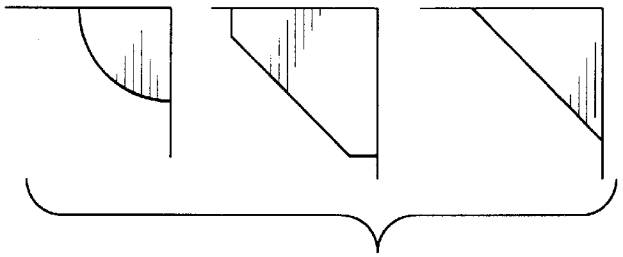
FIG. 7B is a top view of basic shelf shapes which can be mounted to inside corners using the mounting components of the present invention.
Figure 7C:
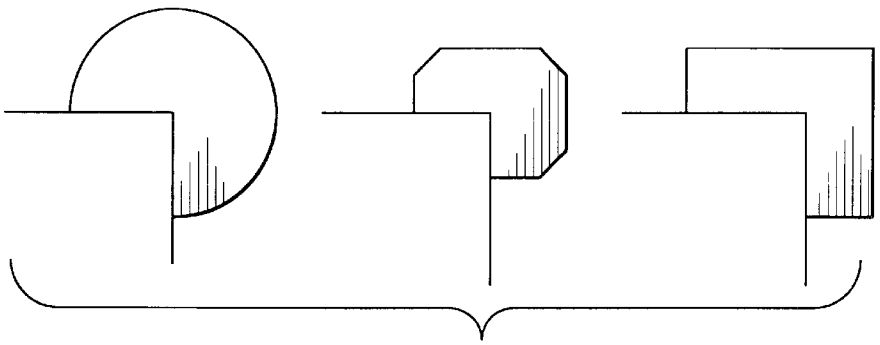
FIG. 7C is a top view of basic shelf shapes which can be mounted to outside corners using the mounting components of the present invention.
Figure 7D:
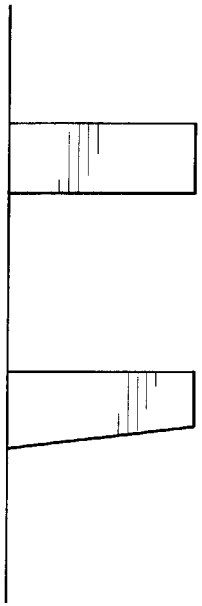
FIG. 7D is a side view of basic shelf shapes which can be mounted to a planar surface using the mounting components of the present invention.

FIG. 6 shows an exploded, perspective view of the shelf 1 reinforcing features that are used when the shelf 1 is supporting maximum weight loads. The overhanging lip 21 is made from ¾" particle board that is ripped and tablesawn to a 45 degree angle. The overhanging lip 21 is attached to the top piece 3 of the shelf 1 using carpenters glue 7 and 1¼" staples 23 with a ¼" crown, while the reinforcing base block 22 is attached to the bottom piece 4 of the shelf 1 by also using carpenters glue 7 and 1¼" staples 23 with a ¼" crown. The shelf ribs 14, end caps, and face 12 are not shown in FIG. 6 for clarity of illustration.

The shelf 1 assembly process for a 12"×36"×2¾" decorative shelf 1 consists of the following procedure. Two pieces 3,4 of ⅝" particle board are cut at 12"×36". One piece 3 of particle board forms the top of the shelf while the other piece 4 of particle board forms the bottom of the shelf. Next, four vertical support ribs 13,14 are cut from 1½" rips of ⅝" particle board. Two of the vertical support ribs 14 form the side edges of the shelf 1, while the other two vertical support ribs 13 form the central interior framework of the shelf 1. The vertical support ribs 13,14 are assembled with the front face piece 12 using 1¼" staples 23 and carpenters glue 7. The vertical support ribs 13,14 are on 12" centers. The modular shelf 1 is constructed by assembling the top piece 3 and the bottom piece 4 with the vertical support ribs 13,14 and the front face piece 12 using 1¼" staples 3"–6" on centers, and by using carpenters glue 7 on all mating surfaces.

A router is used to bull nose all exposed surfaces and edges. All staple holes and porous edges of particle board are filled with an appropriate filler, left to dry, and sanded to a smooth finish. Next, the texture is applied to the shelf 1 to give the shelf 1 a textured finish; however, if a smooth finish is desired, then medite is used instead of particle board. The shelf 1 texture is determined by the existing wall 9 texture on which the shelf 1 is to be placed. The shelf 1 is now ready to paint. The shelf 1 is painted with a color matched paint; that is, with a paint color that matches the paint color of the wall 9. The shelf 1 is now complete and ready for installation.

The first installation step is marking out the location of the shelf 1 on the wall 9. The shelf support 2 is cut from a 1½" rip of ¾" particle board. Latex adhesive 15 is applied between the shelf support 2 and the existing wall 9. Next, drywall screws 8 are run through the shelf support 2 and into every wall 9 stud. If no wall 9 studs are available or if there is an insufficient amount of wall 9 studs, then toggle bolts(not shown) are substituted for the drywall screws 8. A bead of latex adhesive 15 is applied to all mating edges of the shelf support 2 and the shelf 1.

The assembled shelf 1 is now slipped over the shelf support 2 and pin nailed 6" on center with 1½" pin nails 10. A bead of caulk is used to fill the seam between the wall 9 and the shelf 1.

Caulk is also used to fill all pin nail 10 holes. The caulk is finished and cleaned, and the shelf 1 is ready for a paint touch up.

Figure 8:
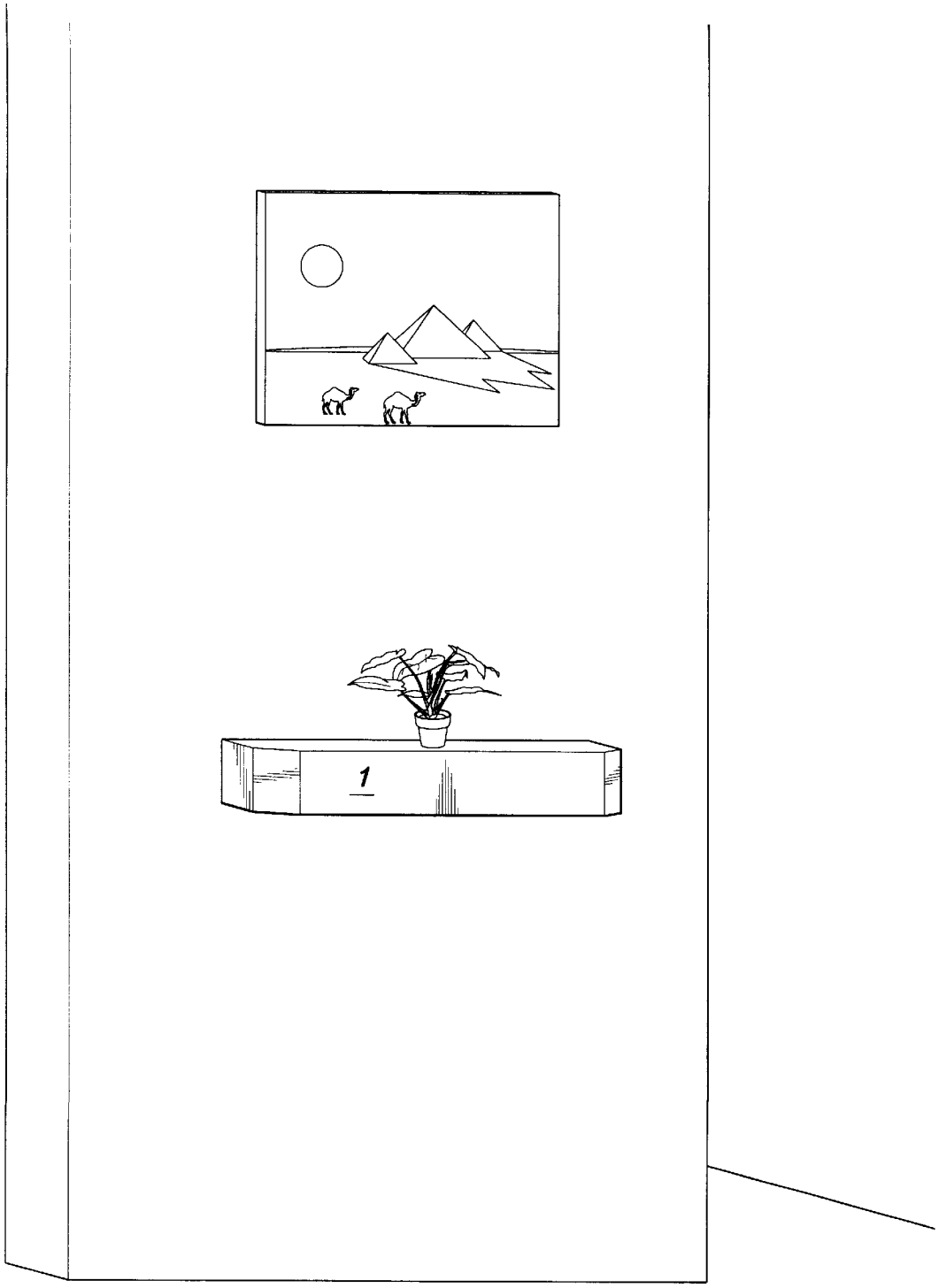
FIG. 8 is an environmental, perspective view of an installed decorative shelf.

FIGS. 7A–7D show the vast variety of shapes available. The modular structure of the present invention allows great latitude in shaping the decorative shelf. As long as an adequate shelf support is maintained, the shaping of the decorative shelf becomes almost limitless. In addition, a broad spectrum of finishes are available; for example, wallpaper, wrapped in carpet, or wood skins. The present invention provides decorative shelving of unparalleled quality having outstanding support strength at an affordable price. FIG. 8 shows an exemplary decorative shelf 24 that has been completely assembled, finished, and installed.

There are numerous variations and modifications of the present invention that are within the scope of the invention as claimed. The preferred embodiments of the present invention disclosed herein are intended to be illustrative only and are not intended to limit the scope of the invention. It is to be understood that the present invention is not limited to the embodiments described above, but encompasses any and all embodiments within the scope of the following claims.

I claim:

1. A shelving assembly adapted to form an aesthetic extension of a wall comprising:

a shelf having a modular framework including a top piece with a rear edge, a bottom piece with a beveled rear edge, a face piece and support pieces, said top piece having a beveled retaining lip attached at the rear edge by carpenters glue and staples;

wherein said face piece has squared edges and forms the face edge of said shelf, and said support pieces has squared edges and includes side support ribs and center support ribs, wherein said side support ribs form sides of said shelf and said center support ribs provide vertical support for the shelf;

whereby said center support ribs being concealed internally of said shelf within said top piece, said bottom piece, said face piece, and said side support ribs; and a unitary shelf support having a beveled top edge and a beveled bottom edge, said beveled top edge being secured to said beveled retaining lip by carpenters glue and nails, and said beveled bottom edge being secured to said beveled rear edge of said bottom piece of said shelf, said unitary shelf support being secured to a wall by a combination of an adhesive and screws;

wherein said beveled top edge of said shelf support and said beveled bottom edge are parallel and at an angle about 45°.

2. A shelving assembly comprising:

a shelf having a modular framework including a top piece with a rear edge, a bottom piece with a beveled rear edge, a face piece and support pieces, said top piece having a beveled retaining lip attached at the rear edge; and a unitary shelf support having a beveled top edge and a beveled bottom edge, said beveled top edge being secured to said beveled retaining lip and said beveled bottom edge being secured to said beveled rear edge of said shelf;

wherein said shelf support is secured to a wall using a combination of an adhesive and screws; and wherein said beveled top edge of said shelf support and said beveled bottom edge are parallel and at an angle about 45°.

3. The shelving assembly according to claim 2, wherein said support pieces has squared edges and includes side support ribs and center support ribs, wherein said side support ribs form sides of said shelf and said center support ribs provide vertical support for the shelf.

4. The shelving assembly according to claim 2, wherein said beveled retaining lip is attached at the rear edge of said top piece using carpenters glue and staples.

5. The shelving assembly according to claim 2, wherein said shelf is secured to said shelf support using carpenters glue and nails.

6. The shelving assembly according to claim 2, wherein said face piece has squared edges and forms the face edge of said shelf.

* * * * *